US006716152B2

(12) United States Patent
Wood

(10) Patent No.: US 6,716,152 B2
(45) Date of Patent: Apr. 6, 2004

(54) CENTRIFUGE WITH ORBITING BOBBINS

(75) Inventor: Philip Leslie Wood, Uxbridge (GB)

(73) Assignee: Brunel University, Middlesex (GB)

( * ) Notice: Subject to any disclaimer, the term of this patent is extended or adjusted under 35 U.S.C. 154(b) by 84 days.

(21) Appl. No.: 10/075,135

(22) Filed: Nov. 20, 2001

(65) Prior Publication Data

US 2002/0119881 A1 Aug. 29, 2002

(51) Int. Cl.[7] ..... B04B 5/02
(52) U.S. Cl. ..... 494/33
(58) Field of Search ..... 494/19, 31–33, 494/83, 84; 366/217, 288

(56) References Cited

U.S. PATENT DOCUMENTS

| | | | | |
|---|---|---|---|---|
| 790,081 | A | * | 5/1905 | Seger |
| 1,349,235 | A | * | 8/1920 | Stout |
| 3,420,436 | A | * | 1/1969 | Ito |
| 3,443,798 | A | * | 5/1969 | Overcashier et al. |
| 3,503,157 | A | * | 3/1970 | Harper |
| 4,063,687 | A | * | 12/1977 | Szego |
| 4,132,484 | A | * | 1/1979 | Kimmel |
| 4,199,459 | A | * | 4/1980 | Filipowicz et al. |
| 4,711,402 | A | * | 12/1987 | Drager et al. |

FOREIGN PATENT DOCUMENTS

| | | | |
|---|---|---|---|
| CH | 70561 | * | 10/1915 |
| GB | 1346362 | * | 2/1974 |
| GB | 2013098 | * | 8/1979 |
| GB | 2356365 | * | 5/2001 |
| JP | 43-23374 | * | 10/1968 |
| SU | 1242241 | * | 7/1986 |
| SU | 1373451 | * | 2/1988 |
| SU | 1622017 | * | 1/1991 |
| WO | 97/23297 | * | 7/1997 |

* cited by examiner

*Primary Examiner*—Charles E. Cooley
(74) *Attorney, Agent, or Firm*—Craig A. Fieschko, Esq.; DeWitt Ross & Stevens S.C.

(57) ABSTRACT

A centrifuge includes a rotor around which a plurality of bobbins rotate. Each bobbin bears one or more fluid-carrying passages through which liquid analyte is passed for centrifuging. Supporting the bobbins on the rotor is a support member which provides a cylindrical inner surface. The inner surface supports the bobbins on rotation thereof to prevent high frictional torques from the bearings of the bobbins.

27 Claims, 6 Drawing Sheets

CENTRIFUGE WITH ORBITING BOBBINS

FIELD OF THE INVENTION

This disclosure concerns an invention relating generally to centrifuges.

BACKGROUND OF THE INVENTION

A current design of centrifuge has a stationary sun gear about which bobbins rotate in a similar manner to that of the planets around the sun. The bobbins are placed in a framework called the rotor, which ensures that the bobbins can rotate about the sun gear. Attached to each bobbin is a gear which meshes with the sun gear. The flying leads are used to transfer chromatography fluids from the stationary surroundings to the rotating bobbins, where a chromatography process occurs, and then back to the stationary surroundings for processing or analysis.

The weight of the bobbins is taken by bobbin bearings placed between the bobbins and the rotor. The bobbin bearings have to rotate freely while operating under very heavy loads. The current type of bearing used is a rolling element bearing. This type of bearing has rolling elements (e.g., spheres, cylinders, rollers) which rotate between the races. These rolling elements are separated by an item called a cage.

A fundamental problem with this design of centrifuge is that the rolling elements and the cages of the bobbin bearings exert large loads upon each other due to tangential acceleration caused by the motion of the bobbins about the sun gear. These loads greatly increase the frictional torque of the bearing above that normally expected, the theoretical frictional torque. FIG. 1 compares the theoretical and measured torque values for a current design of J-type planet centrifuge. There is a need to increase the performance of these centrifuges which is achieved by increasing the centripetal acceleration generated. The centripetal acceleration can be increased by either increasing the rotational speed or increasing the planetary radius or a combination thereof. As the centripetal acceleration increases so does the tangential acceleration (the tangential acceleration being a component of the centripetal acceleration) acting between the rolling elements and the cages of the bobbin bearings. This in turn increases the frictional torque generated in the bobbin bearings. Higher performance from these centrifuges can be simply achieved by fitting much more powerful drive motors, however this eventually leads to overheating of the bobbin bearings and their failure. The amount of cooling of the bobbin bearings could be increased; however, this adds complexity and weight, the latter aggravating the problem. Increasing the amount of cooling only increases the level of centrifuge performance until the frictional problem of bobbin bearings is reasserted.

SUMMARY OF THE INVENTION

The invention involves a centrifuge which is intended to at least partially solve the aforementioned problems. To give the reader a basic understanding of some of the advantageous features of the invention, following is a brief summary of preferred versions of the centrifuge. As this is merely a summary, it should be understood that more details regarding the preferred versions may be found in the Detailed Description set forth elsewhere in this document. The claims set forth at the end of this document then define the various versions of the invention in which exclusive rights are secured.

In a particularly preferred version of the invention, a centrifuge includes a central guide shaft; a plurality of bobbins located around the guide shaft and rotatable therearound; and a support member around the bobbins which provides a substantially cylindrical inner surface around which the bobbins can rotate, and which supports the bobbins. The support member provides means to support the bobbins during rotation thereof and can substantially avoid the aforementioned problems of prior art centrifuges. The support member is preferably free to rotate. This allows for manufacturing variations in the diameter of the bobbins and the diameter of the inner surface of the support member. However, it is possible for there to be a fixed drive ratio between bobbins and the support member if all of these parts are manufactured very accurately.

In one embodiment, the central guide shaft is a rotor, which may be driven to drive the bobbins. In another embodiment, the support member is driven, imparting rotation to the bobbins. Where the guide shaft is a rotor the support member may be fixed; where the support member is rotatable, the guide shaft may be fixed.

There are preferably provided two bobbins, although embodiments have been tested with up to ten bobbins (this not necessarily being the maximum number).

The bobbins advantageously have diameters which are substantially identical, preferably within a tolerance of ±0.1%, most preferably of ±0.05%. With the preferred embodiment, the actual diameter of the bobbins is not important, solely their relative diameters.

Advantageously, the bobbins are located by plane bearings. This feature assists in location and guidance of the bobbins. These bearings do not support the weight of the bobbins, and rather the support member is supporting this weight. This arrangement avoids the high frictional torque. Alternatives are a needle roller bearing, a hydrostatic bearing in place of a plane bearing, or any other suitable bearing. Similarly, the support member, when rotatable, can be provided with one or more bearings for location and guidance.

The bobbins rotate in the rotor, preferably with no gearing between the rotor and the bobbins. The sun gear, being fixed in space and therefore stationary, meshes with the gears attached the bobbins. The rotor and sun gear have the same central axis. The rotor rotates and the bobbins rotate about the rotor central axis and also about their axis due to the meshing of the sun and bobbin gears.

It is possible with the foregoing preferred versions of the invention to provide speeds of rotation of 1,600 to 3,000 rpm and higher, using motors which would only produce 800 rpm speeds with prior centrifuge designs known to the inventor.

Further advantages, features, and objects of the invention will be apparent from the following detailed description of the invention in conjunction with the associated drawings.

BRIEF DESCRIPTION OF THE DRAWINGS

An exemplary embodiment of the invention will now be described with reference to the accompanying drawings, in which.

DETAILED DESCRIPTION OF PREFERRED EMBODIMENTS OF THE INVENTION

Figure 1:
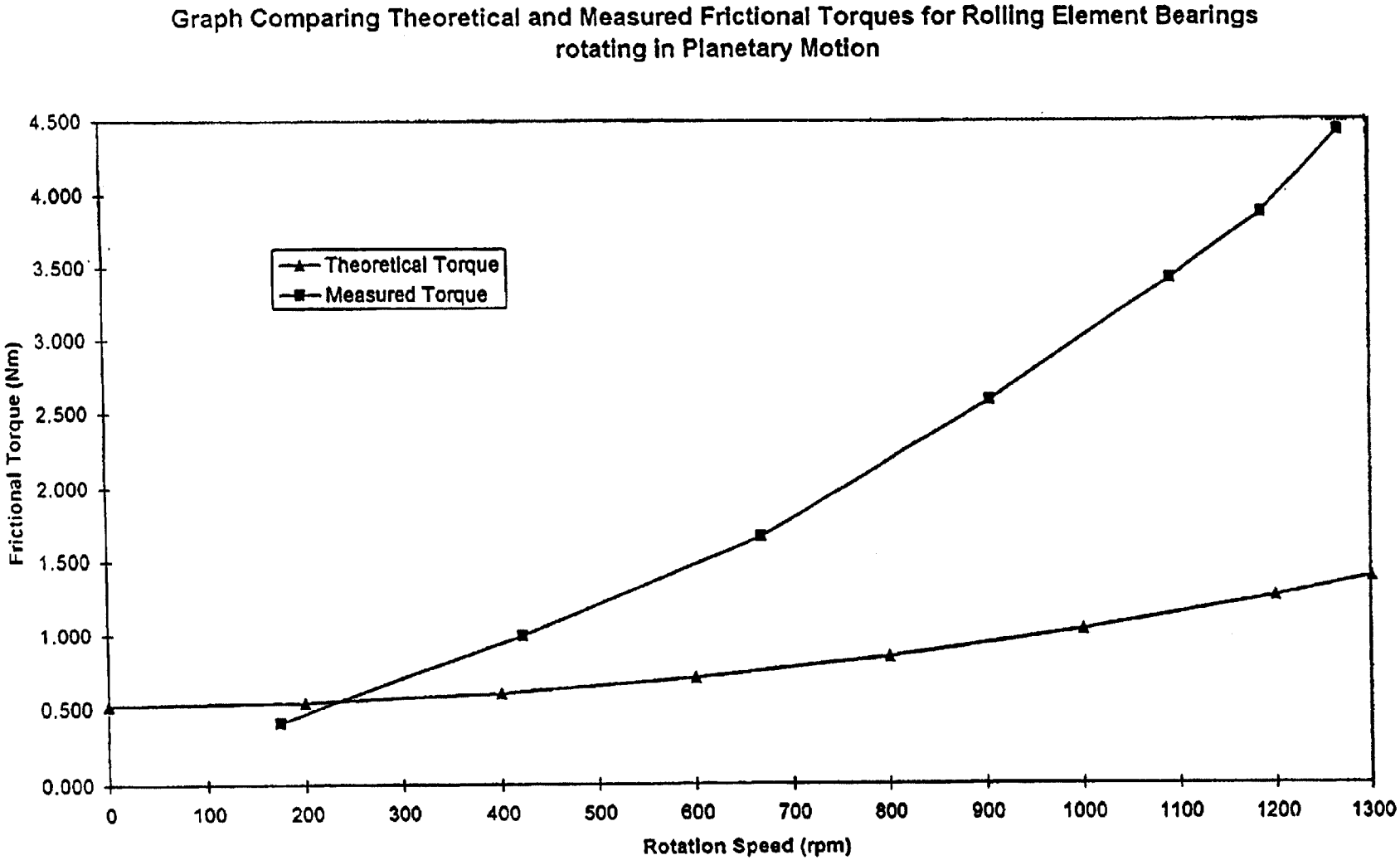
FIG. 1 is a graph of frictional torque over rotation speed of a prior art centrifuge of planetary type.
Figure 2:
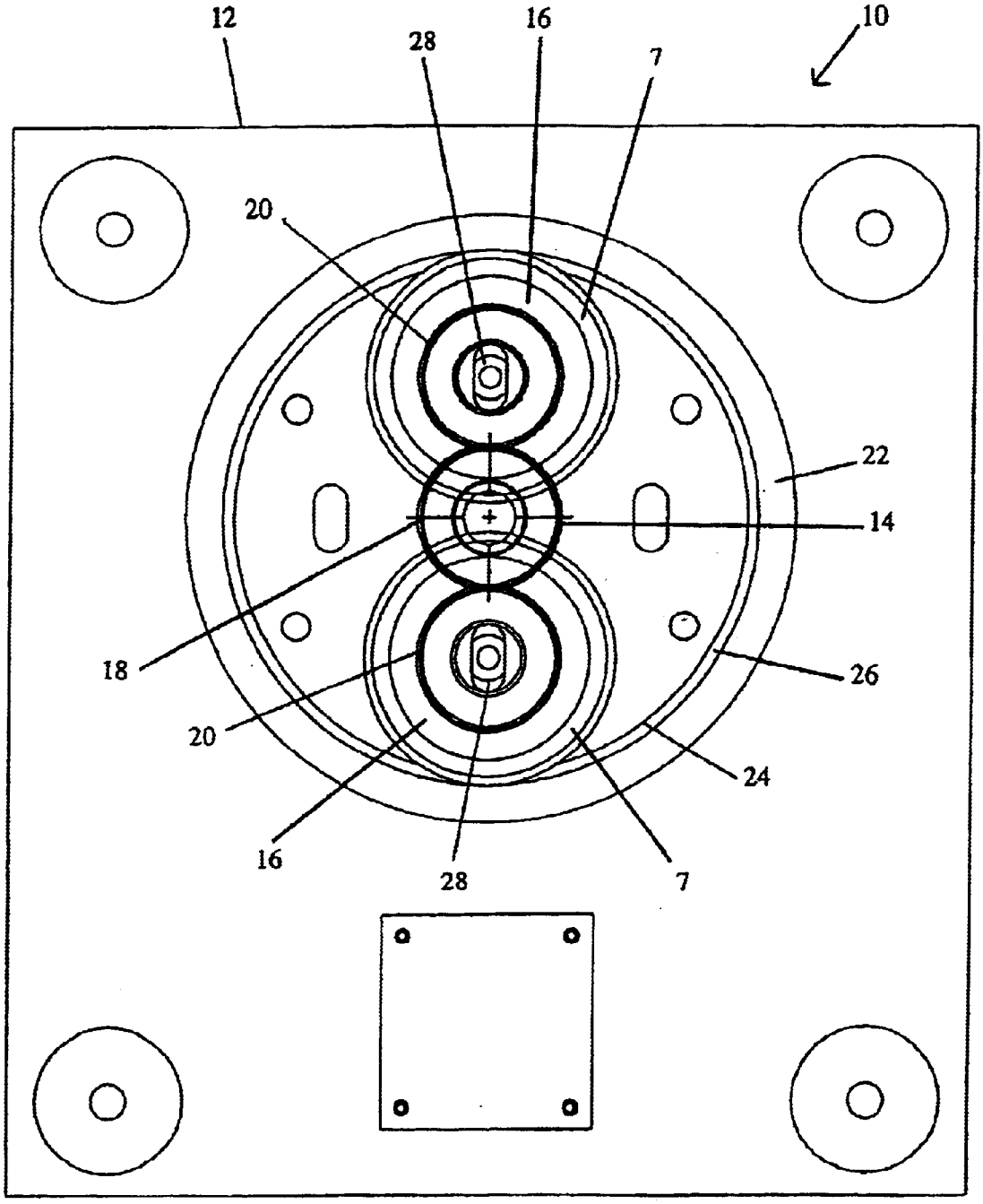
FIG. 2 is a schematic diagram in partial cross-section of an embodiment of centrifuge in front elevation.
Figure 3:
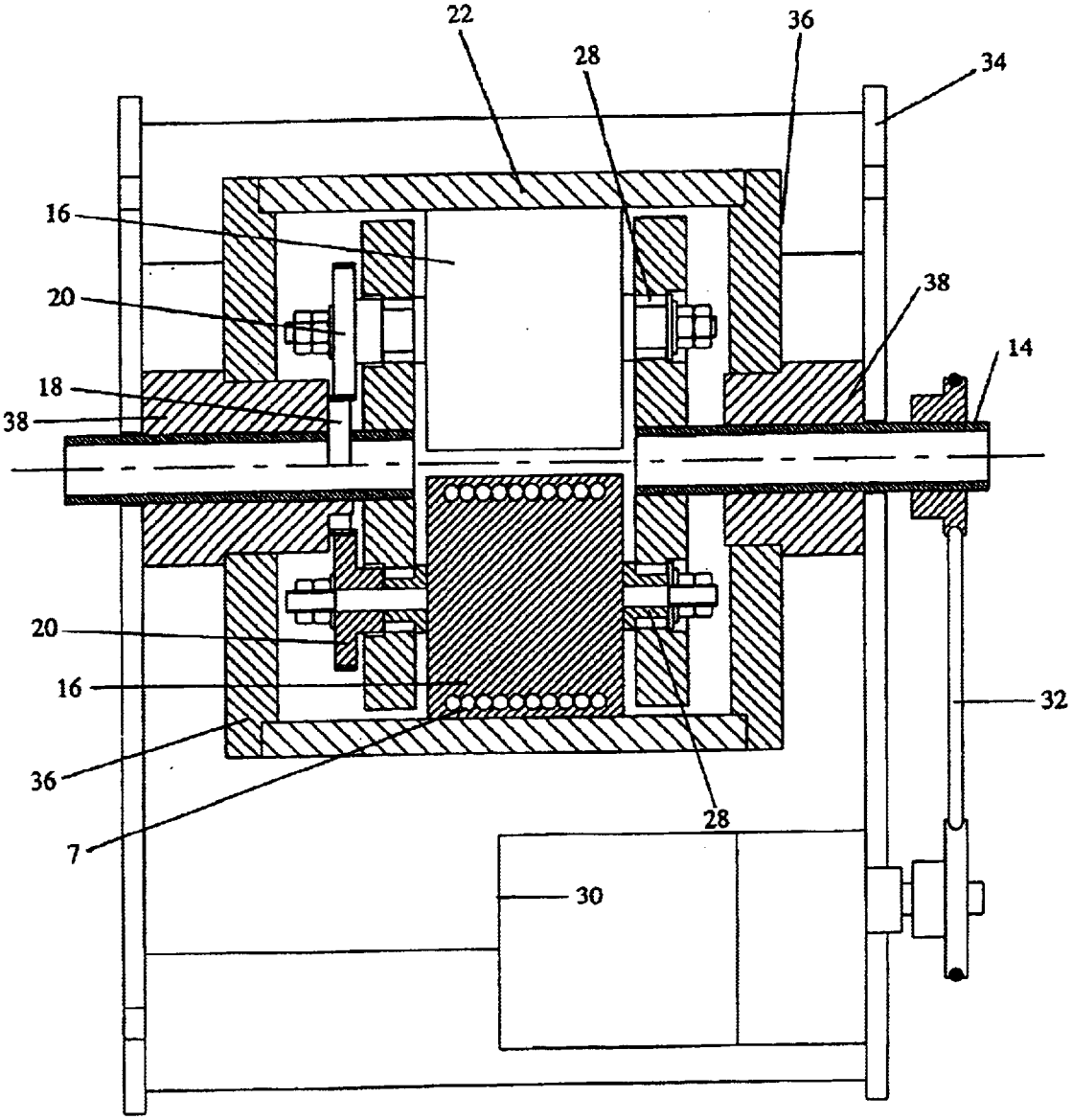
FIG. 3 is a schematic diagram in partial cross-section of the centrifuge of FIG. 2 in side elevation.
Figure 4:
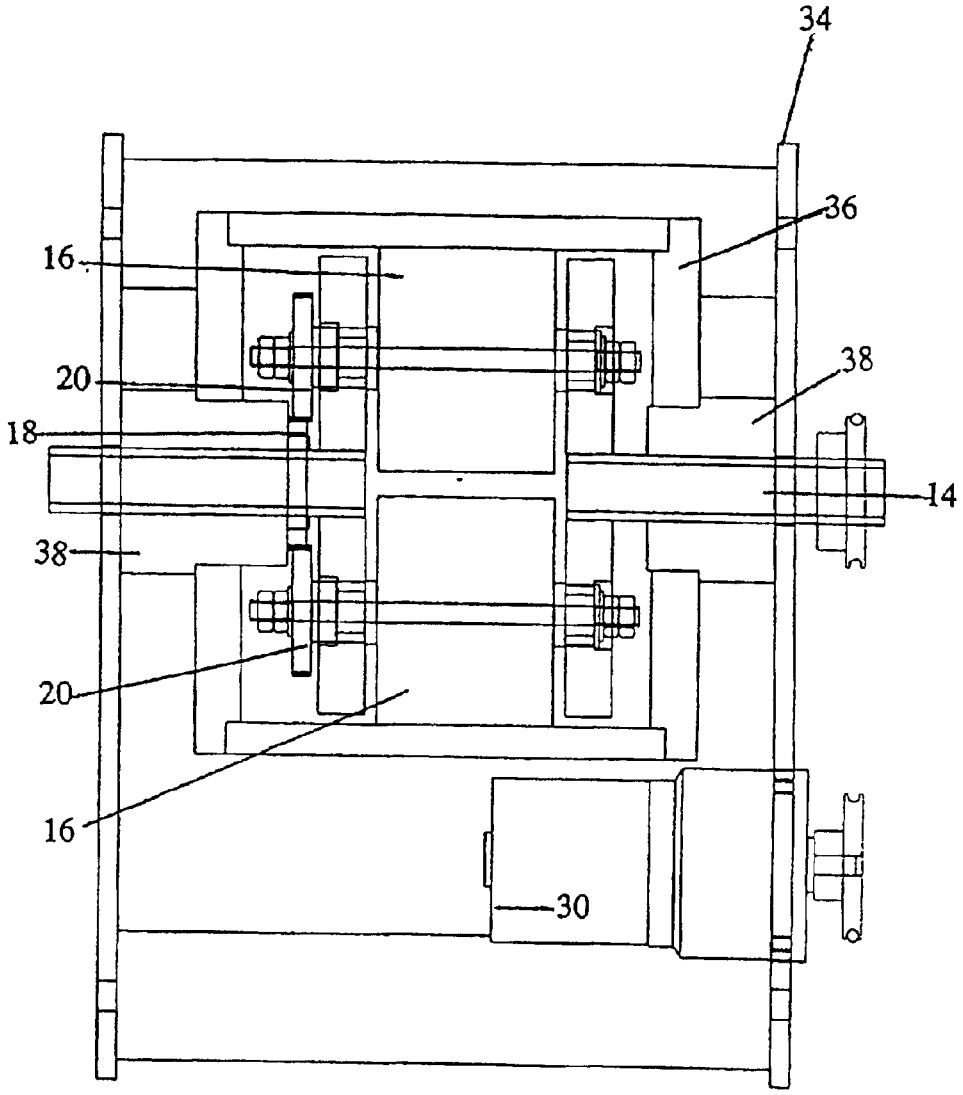
FIG. 4 is a schematic diagram in partial cross-section of the centrifuge of FIG. 2 in side elevation.

Referring to FIGS. 2 to 4, an embodiment of centrifuge 10 is shown within a casing 12. The principal elements of the centrifuge 10 include a rotor 14 around which a plurality of bobbins 16, two in this embodiment, rotate. Around each bobbin 16 there is wound a tubing 7 through which liquid analyte is passed for centrifuging. The tubing and connections into and out of the centrifuge 10 are standard in the art so are not described in detail.

The centrifuge is also provided with a support member 22, for example a drum, which provides an inner surface 24 which is substantially circular/cylindrical. The inner surface 24 supports the bobbins 16 as can be seen in particular in FIGS. 2 and 3. As will be apparent in FIG. 2, there may be provided a guide 26 engageable by an outer surface of the bobbins 16 to keep the location of the bobbins 16 relative to the support member 22.

Each bobbin 16 is provided with a plane bearing 28 which allows the bobbins 16 to move radially to take up any tolerance between them and the inner surface 24, while remaining engaged with the gears 18 and 20. There is also provided (shown in FIG. 7) a location support, typically rotatably coupled to the rotor 14, for locating the bobbins 16 relative to one another.

In conventional manner and as can be seen in FIGS. 3 and 4, the rotor 14 is coupled to a motor 30 by a chain 32 or other suitable drive, which rotates the rotor 14 at the desired speed and thereby to impart rotation to the bobbins 16. These Figures show the arrangement of the plane bearings 28, which allow radial movement of the bobbins 16 to abut the inner surface of the drum 22 and yet retain engagement between gears 18 and 20. Gear 18 is the sun gear which is fixed to item 38 and does not rotate. Rotor 14 passes through the center of item 38 and gear 18.

FIGS. 3 and 4 also show a support frame 34 which supports the motor 30, the rotor 14 and, indirectly, the drum 22. Of course, the support frame 34 must be sufficiently rigid to support the assembly even during high speed revolution.

In this embodiment, the drum 22 is freely rotatable and in this respect is guided within the frame 34. For this purpose, in this embodiment the drum 22 is supported by two discs 36 on respective radial bearings 38 fixed to the frame 34. The actual form of the guides and, in this form the actual number of discs and bearings, is a matter of choice in dependence upon the chosen design of centrifuge.

Figure 6:
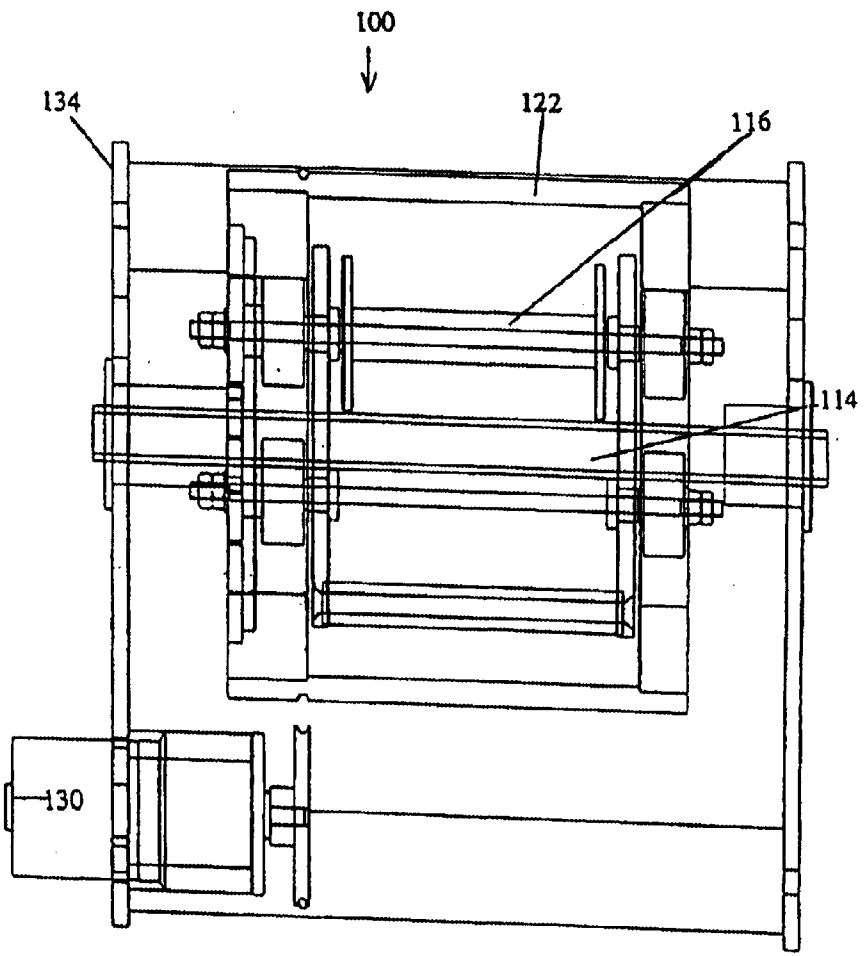
FIG. 6 is a schematic diagram in partial cross-section of the centrifuge of FIG. 5 in side elevation.
Figure 5:
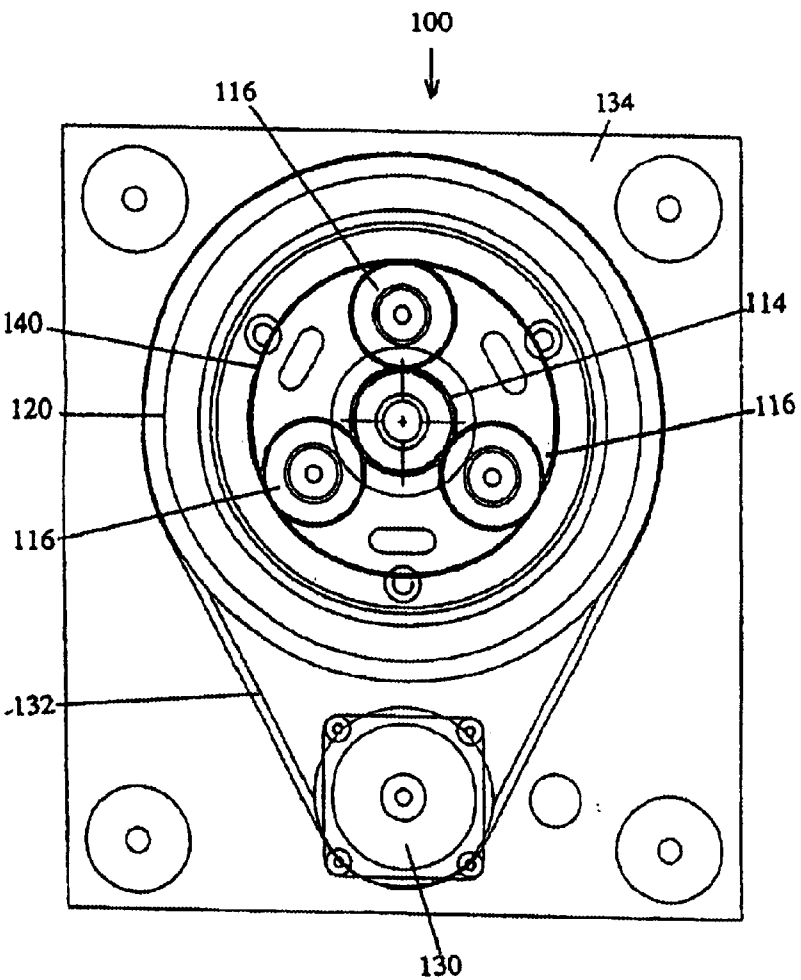
FIG. 5 is a schematic diagram in partial cross-section of another embodiment of centrifuge in front elevation; with the weight of the bobbins (3-off) supported by rollers at each end of a bobbin.

FIGS. 5 and 6 show another embodiment of centrifuge 100 which includes a driven drum 122, three bobbins 116 and a rotor 114. The bobbins 116 include gears 120 which engage stationary gear 118. Similarly, the gearing 120 of the bobbins 116 engages gearing 140 provided on the drum 122.

A suitable belt 132 or other suitable drive is coupled to a motor 130 to drive the drum 122. A suitable support frame 134 supports the assembly.

In use, both embodiments described above cause rotation of the bobbins 16, 116 around the drum 22, 122 and rotor 14, 114, which creates the centrifugal effect in the tubing (7 in FIG. 3: not shown in FIGS. 5–6) wound around each bobbin 16, 116. The drum 22, 122 supports the weight of the bobbins 16, 116 during rotation and avoids the radial load normally applied to the bearing of the bobbins and which causes the problems experienced with prior art centrifuges. The plane bearings 28 thus only provide location and guidance and do not take any load.

It will also be apparent that the weight of the bobbins 16, 116 is preferably counter-balanced by their number and location relative to one another, so that there are no resultant radial forces on the assembly. This considerably eases the problems during use of the centrifuge.

As a result of these advantages, considerably higher speeds are achievable with the same power motor. It is also possible to increase the size of the centrifuge without suffering some of the problems which would be experienced with prior designs.

The bobbins 16, 116 are of very similar dimensions, preferably having diameters which are within about ±0.1% and most preferably within ±0.05% of one another. As a result of the structure of the embodiments, the exact dimensions of the bobbins 16, 116 are not important, with errors being taken up by the plane bearings 28. However, relative match of dimensions is important to ensure no substantial friction is developed by the bobbins seeking to rotate at different speeds.

Figure 7:
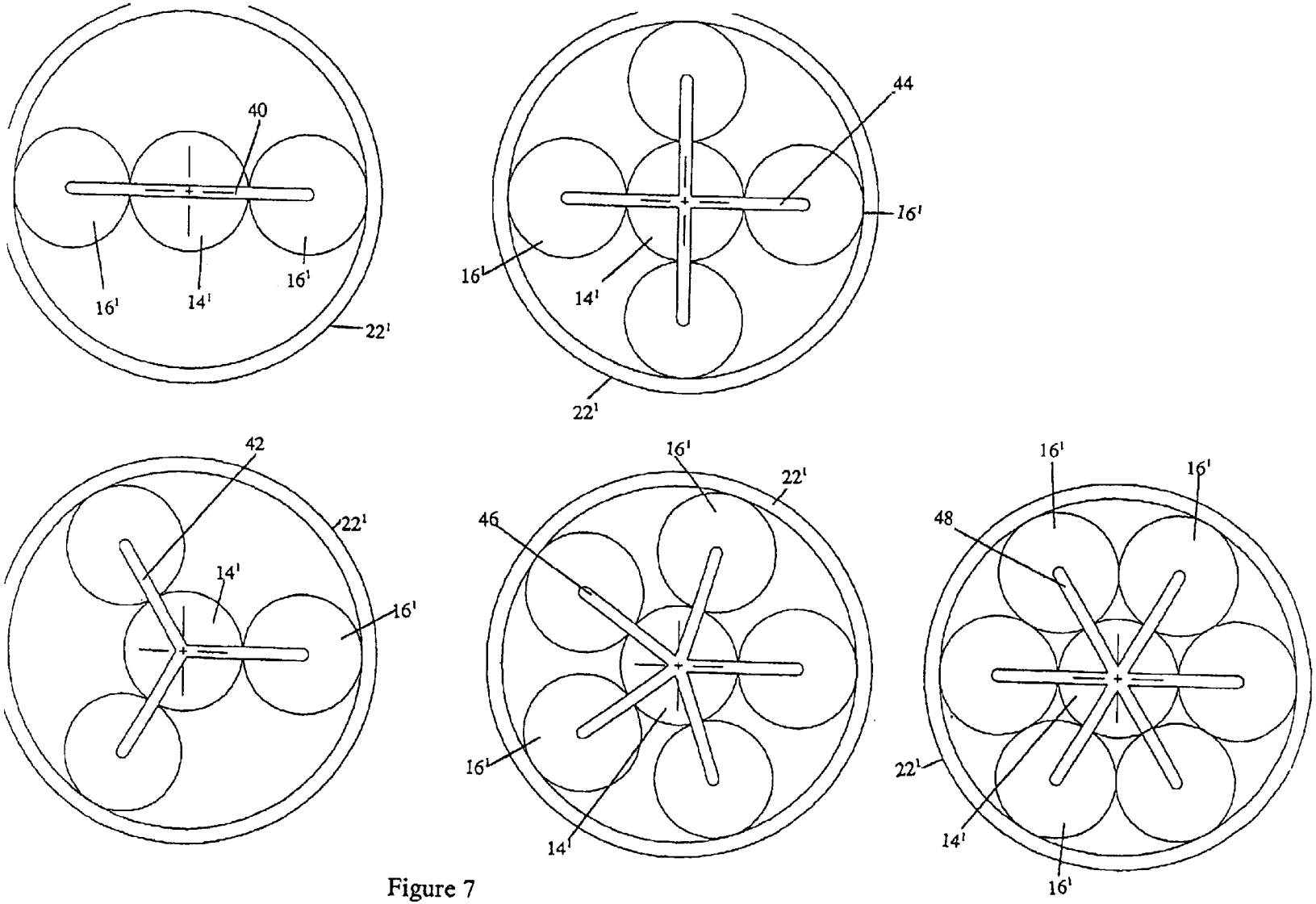
FIG. 7 shows various possible arrangements of bobbins for the centrifuges of FIGS. 2 to 6.

It will also be apparent, and as shown in FIG. 7, that the bobbins 16, 116 are coupled to the rotors by struts intended to retain the position of the bobbins 16, 116 relative to one another.

FIG. 7 shows schematically various arrangements of bobbins 16' around a rotor 14' and accommodated within a drum 22'. It also shows the supports 40–48 used to locate the bobbins 16' relative to one another and on which the bobbins 16' are free to rotate and to move radially at least to a certain extent.

Of course, the example with six bobbins 16', as with any arrangement having more than six bobbins 16', the bobbins are smaller to avoid them touching one another. The number of bobbins actually provided will be dependent upon the application and customer requirements.

It will be apparent to those of ordinary skill in this field that the drive mechanism for driving the bobbins 16, 16', 116 is not relevant to the embodiments described herein. The gear drive (J-type) shown could be replaced by a belt/chain (I-type) or any other drive version.

As mentioned above, it is not necessary to have a rotating drum. This could be fixed. Moreover, it would be possible to provide a system in which the supporting surface is fixed and which is provided with a rotating cylinder on which the bobbins bear and which couples to the inner surface of the fixed support by a plurality of roller bearings. This could be in place of the disc 36 and bearing 38 of the first-described embodiment.

In place of phase bearings small diameter rolling element bearings could also be used as any induced frictional torque is proportional to the rolling element bearing's diameter. Hydrostatic bearings could also be used in place of the plane bearing.

It should be understood that preferred versions of the invention have been described above in order to illustrate how to make and use the invention. The invention is not intended to be limited to these versions, but rather is intended to be limited only by the claims set out below.

Thus, the invention encompasses all alternate versions that fall literally or equivalently within the scope of these claims.

What is claimed is:

1. A centrifuge comprising:

a. a central guide shaft, b. a plurality of bobbins located around the guide shaft and rotatable therearound, at least one of the bobbins bearing fluid-bearing passages extending about its circumference; and c. a freely rotatable support member located around the bobbins and providing a substantially cylindrical inner surface around which the bobbins can rotate and operable to support the bobbins.

2. A centrifuge according to claim 1 wherein the support member is a drum.

3. A centrifuge according to claim 2 wherein the support member is freely rotatable.

4. A centrifuge according to claim 1 wherein the central guide shaft is a rotor.

5. A centrifuge according to claim 4, wherein the rotor is coupled to a drive to thereby allow driving of the bobbins.

6. A centrifuge according to claim 1 wherein the support member is rotatable, and the centrifuge further comprises a drive unit coupled to the support member to rotate the support member, whereby the bobbins may be rotated.

7. A centrifuge according to claim 1 wherein the bobbins are located on plane bearings.

8. A centrifuge comprising:

a. a guide shaft, b. two or more bobbins orbitally arranged about the guide shaft, each bobbin having a fluid-carrying passage wound thereabout; and c. a freely rotatable support member having a substantially cylindrical inner surface whereupon the bobbins rotate.

9. A centrifuge according to claim 8 wherein the central guide shaft is a rotor coupled to a drive to thereby allow driving of the bobbins.

10. A centrifuge according to claim 8 wherein the bobbins are located on plane bearings.

11. A centrifuge according to claim 8 wherein the support member is a drum.

12. A centrifuge comprising:

a. a guide shaft;

b. two or more bobbins riding on the guide shaft, each bobbin bearing a fluid-carrying passage extending about its circumference; and c. a freely rotatable support member having a substantially cylindrical inner surface whereupon the bobbins ride.

13. A centrifuge according to claim 12 wherein the bobbins are located on plane bearings.

14. A centrifuge according to claim 12 wherein the guide shaft is a rotor, the rotor being drivable to rotate the bobbins.

15. A centrifuge according to claim 12 wherein the support member is a drum.

16. A centrifuge comprising:

a. a central guide shaft, b. a plurality of bobbins located around the guide shaft and rotatable therearound, at least one of the bobbins bearing fluid-bearing passages extending about its circumference;

c. a rotatable support member located around and supporting the bobbins, the support member including a substantially cylindrical inner surface around which the bobbins can rotate; and d. a drive unit coupled to the support member to rotate the support member, whereby the bobbins can be rotated.

17. A centrifuge according to claim 16 wherein the central guide shaft is a rotor, the rotor being drivable to rotate the bobbins.

18. The centrifuge of claim 16 wherein the support member is a drum.

19. A centrifuge comprising:

a. a guide shaft, b. a plurality of bobbins located around the guide shaft, the bobbins being rotatable therearound, wherein at least one of the bobbins bears enclosed fluid-bearing passages extending about its circumference; and c. a support member located around the bobbins, the support member including a substantially cylindrical inner surface about which the bobbins can rotate and operable to support the bobbins.

20. A centrifuge according to claim 19 wherein the support member is a drum.

21. A centrifuge according to claim 19 wherein the support member is freely rotatable.

22. A centrifuge according to claim 19 wherein the central guide shaft is a rotor.

23. A centrifuge according to claim 19 wherein the support member is rotatable, and the centrifuge further comprises a drive unit coupled to the support member to rotate the support member, whereby the bobbins may be rotated.

24. A centrifuge according to claim 19 wherein the bobbins are located on plane bearings.

25. A centrifuge comprising:

a. a guide shaft, b. two or more bobbins orbitally arranged about the guide shaft, each bobbin having an enclosed fluid-carrying passage wound thereabout; and c. a support member having a substantially cylindrical inner surface whereupon the bobbins rotate.

26. A centrifuge according to claim 25 wherein the support member is freely rotatable.

27. A centrifuge according to claim 25 wherein the guide shaft is a rotor engaging and driving the bobbins.

* * * * *